US008997889B2

(12) United States Patent
Finkenzeller et al.

(10) Patent No.: US 8,997,889 B2
(45) Date of Patent: Apr. 7, 2015

(54) UNDERWATER DRILLING ARRANGEMENT AND METHOD FOR INTRODUCING A FOUNDATION ELEMENT INTO A BED OF A BODY OF WATER

(75) Inventors: Stefan Michael Finkenzeller, Reichertshofen (DE); Ulrich Wiedenmann, Schrobenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 376 days.

(21) Appl. No.: 13/481,683

(22) Filed: May 25, 2012

(65) Prior Publication Data

US 2012/0298419 A1 Nov. 29, 2012

(30) Foreign Application Priority Data

May 27, 2011 (EP) ..... 11004380

(51) Int. Cl.

| | |
|---|---|
| ***E21B 7/124*** | (2006.01) |
| ***E21B 7/12*** | (2006.01) |
| ***E02D 13/04*** | (2006.01) |
| ***E02D 5/40*** | (2006.01) |
| ***E02D 7/28*** | (2006.01) |
| ***E02D 27/52*** | (2006.01) |

(52) U.S. Cl.

CPC *E02D 13/04* (2013.01); *E02D 5/40* (2013.01); *E02D 7/28* (2013.01); *E02D 27/52* (2013.01); *E21B 7/124* (2013.01)

(58) Field of Classification Search

USPC ..... 175/7, 10; 166/358, 349, 341, 342, 71, 166/78; 405/224, 227, 228, 232, 249, 253

See application file for complete search history.

(56) References Cited

U.S. PATENT DOCUMENTS

| | | | | |
|---|---|---|---|---|
| 3,672,447 A | | 6/1972 | Kofahl | |
| 3,846,991 A | * | 11/1974 | Wisotsky | 405/228 |
| 4,216,835 A | | 8/1980 | Nelson | |

(Continued)

FOREIGN PATENT DOCUMENTS

| | | |
|---|---|---|
| CN | 102362033 A | 2/2012 |
| DE | 43 08 856 C1 | 5/1994 |

(Continued)

OTHER PUBLICATIONS

An excerpt of Chinese Office Action issued, which corresponds to Chinese Patent Application No. 201210165423.X and is related to U.S. Appl. No. 13/481,683.

(Continued)

*Primary Examiner* — James G Sayre

(74) *Attorney, Agent, or Firm* — Studebaker & Brackett PC

(57) ABSTRACT

The invention relates to an underwater drilling arrangement and a method for introducing a foundation element into a bed of a body of water comprising a submersible working platform for placement onto the bed of a body of water, several ground contact elements which are arranged in an adjustable manner on the working platform for aligning the working platform on the bed of a body of water, and at least one guide pipe for receiving and guiding the drilling tool. For an improved anchoring provision is made according to the invention for the guide pipe to be supported in a longitudinally displaceable and rotatable manner on the working platform and for a guide pipe drive to be provided on the working platform for driving the guide pipe in a rotating manner.

12 Claims, 3 Drawing Sheets

(56) References Cited

U.S. PATENT DOCUMENTS

Figure 3:
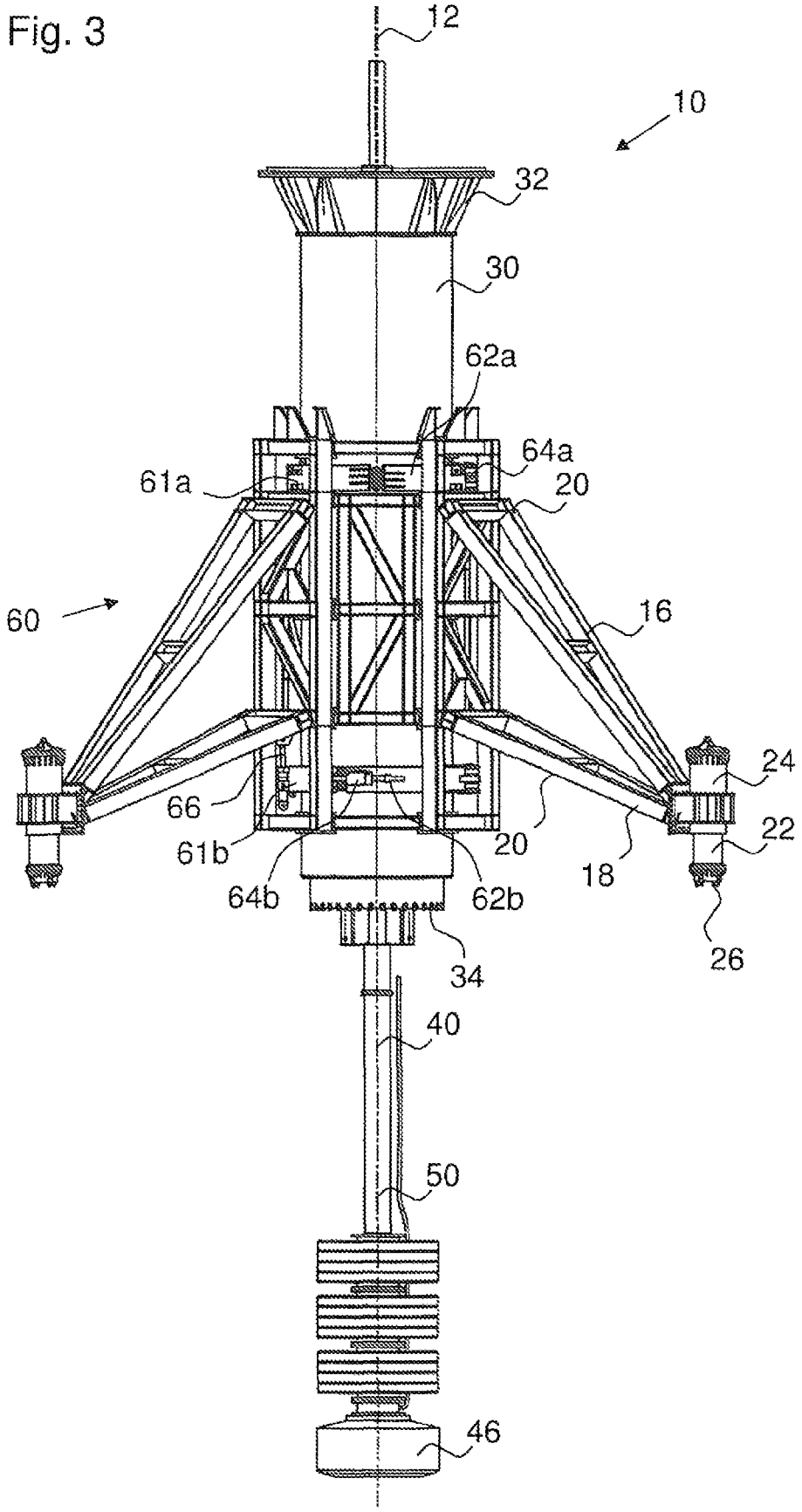

| | | | | |
|---|---|---|---|---|
| 4,744,698 | A * | 5/1988 | Dallimer et al. | 405/226 |
| 5,244,312 | A * | 9/1993 | Wybro et al. | 405/204 |
| 6,354,767 | B1 * | 3/2002 | Jones | 405/232 |
| 2011/0158752 | A1 | 6/2011 | Hitchin | |
| 2011/0211917 | A1 | 9/2011 | Jones | |
| 2011/0318113 | A1 | 12/2011 | Fraenkel | |
| 2012/0177447 | A1 | 7/2012 | Fraenkel et al. | |

FOREIGN PATENT DOCUMENTS

| | | | | |
|---|---|---|---|---|
| GB | 2467842 | A | 8/2010 | |
| GB | 2469190 | A | 10/2010 | |
| GB | 2473683 | A | 3/2011 | |
| JP | S48-19402 | | 3/1973 | |
| JP | S48-86304 | | 11/1973 | |
| JP | S56-44875 | Y2 | 10/1981 | |
| JP | S58-103285 | U | 7/1983 | |
| JP | S61-169151 | U | 10/1986 | |
| JP | H07-310489 | A | 11/1995 | |
| JP | 2006-083573 | A | 3/2006 | |
| WO | 2009/024739 | A2 | 2/2009 | |
| WO | 2010/015799 | A2 | 2/2010 | |
| WO | WO 2010015799 | A2 * | 2/2010 | E02D 7/28 |
| WO | 2010/112832 | A1 | 10/2010 | |

OTHER PUBLICATIONS

An excerpt of Japanese Office Action; "Decision of Grant," issued, which corresponds to Japanese Patent Application No. 2012-112024 and is related to U.S. Appl. No. 13/481,683.

European Search Report dated Nov. 15, 2011; EP Application No. 11 00 4380.

* cited by examiner

Fig. 1
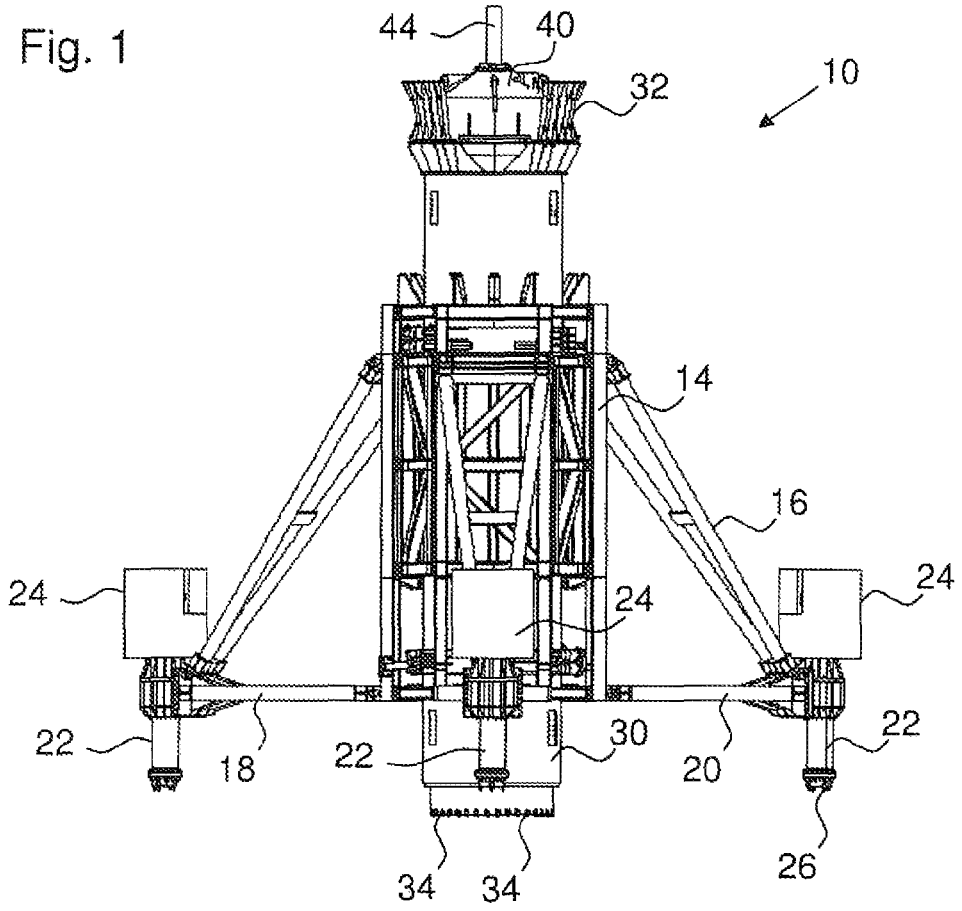
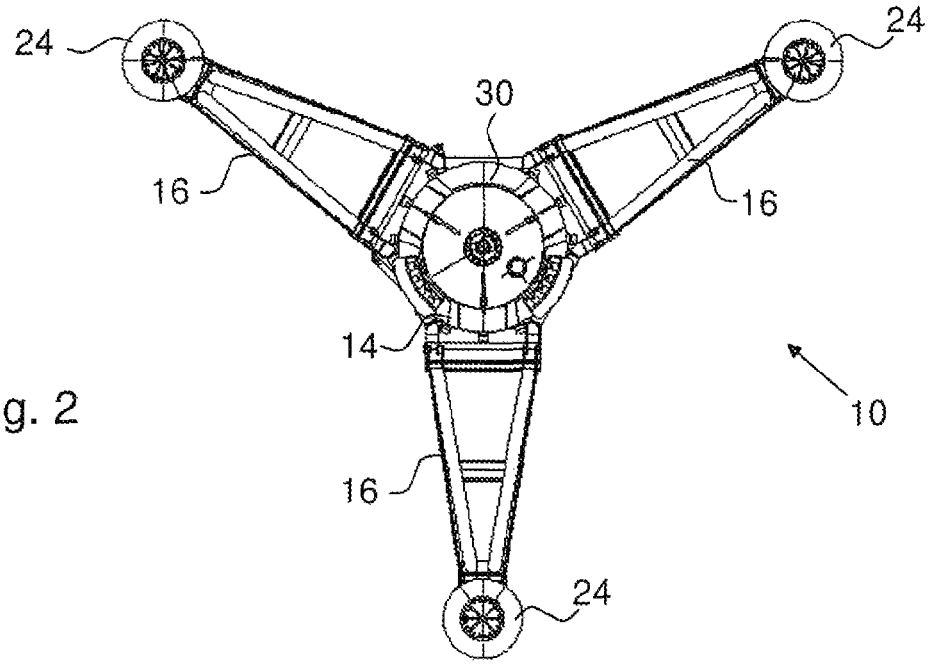
Fig. 2

UNDERWATER DRILLING ARRANGEMENT AND METHOD FOR INTRODUCING A FOUNDATION ELEMENT INTO A BED OF A BODY OF WATER

The invention relates to an underwater drilling arrangement for introducing a foundation element into a bed of a body of water comprising a submersible working platform for placement onto the bed of a body of water, several ground contact elements, which are arranged in an adjustable manner on the working platform for aligning the working platform on the bed of a body of water, and at least one guide pipe arranged on the working platform, which is designed to receive and guide a drilling tool driven by a drill drive, in accordance with the preamble of claim 1. Furthermore, the invention relates to a method for introducing a foundation element into a bed of a body of water with an underwater drilling arrangement.

A drilling arrangement of such type serves, for example, for introducing foundation elements for offshore wind plants or for flow turbines in tidal power stations in the sea.

A generic prior art can be taken from GB 2 469 190 A for example. According to this known method the working platform is initially placed onto the bed of a body of water. By means of a horizontal adjustment means located on the working platform a guide pipe with receiving hopper is brought into a specific position, in which a drill-hole is to be produced in the bed of a body of water. Afterwards, a drilling tool driven in a rotating manner is inserted axially into the guide pipe and sunk into the bed of a body of water for forming the drill-hole.

In the case of strong submarine currents there is the risk that the working platform is displaced or drifts off course even before the introduction of the first drill-hole. This risk is especially prevalent if, in addition, the large drilling tool is placed into the guide pipe on the working platform, as this provides the current, at least temporarily, with a considerable target surface. Moreover, due to inaccuracies under water that can never be fully eliminated, considerable transverse forces can be applied to the working platform during the insertion of the drilling tool into the guide pipe, which lead to an undesired displacement of the working platform on the bed of a body of water. In this case a production of the foundation element in a precise position is not possible.

By contrast, an improved method is known from EP 2 322 724 A1. In this underwater drilling arrangement several sleeve-shaped guide pipes are arranged on the working platform, in which a pipe-shaped foundation element is already arranged in each case that receives a drilling tool at the same time. The pipe-shaped foundation element is held via a clamping means on the working platform and can be lowered into a drill-hole after production of the latter.

From WO 02/18711 A1 and EP 0 301 116 A1 drive units for drilling tools can be taken respectively that can be lowered under water.

From U.S. Pat. No. 3,029,608 a known anchoring method can be taken in which a foundation element is introduced into the bed of a body of water using a vibration drive, the vibration drive being arranged above the water surface over a platform.

The invention is based on the object to provide an underwater drilling arrangement and a method for introducing a foundation element into a bed of a body of water, with which a foundation element can be introduced in an especially precise position.

The object is solved on the one hand by an underwater drilling arrangement having the features of claim 1. On the other hand, the object is solved by a method having the features of claim 8. Preferred embodiments of the invention are stated in the respective dependent claims.

The underwater drilling arrangement according to the invention is characterized in that the guide pipe is supported in a longitudinally displaceable and rotatable manner on the working platform and in that on the working platform a guide pipe drive is provided for driving the guide pipe in a rotating manner.

A fundamental idea of the invention is to support a working platform on the bed of a body of water not only by way of the ground contact elements arranged laterally on the working platform. Before the production of the actual drill-hole provision is made according to the invention for the guide pipe supported on the working platform to be driven by itself in a rotating manner and be drilled into the ground by means of a guide pipe drive. As a result, an additional anchoring of the working platform in the bed of a body of water is brought about. For this purpose the guide pipe is driven several meters into the bed of a body of water. This is implemented by means of a guide pipe drive arranged on the working platform.

Following anchoring of the working platform the foundation element can then be introduced into the bed of a body of water using a customary drilling tool, and in doing so the drilling tool is guided along the guide pipe. Due to the fact that the guide pipe is already introduced partly into the bed of a body of water, improved guidance of the drilling tool in the ground is achieved thereby, too. Transverse forces acting on the guide pipe during the insertion of the drilling tool or a foundation element are absorbed directly in the bed of a body of water so that no displacement of the working platform takes place.

According to the invention it is advantageous for the guide pipe to have at its upper end an inserting hopper for inserting the drilling tool. During underwater works this hopper, which normally is of conical design, permits easier insertion of the drilling tool or a pile-shaped foundation element into the guide pipe. The inserting hopper can also be designed on a part of the circumference only as a catch means.

Furthermore, according to the invention it is preferred that at its lower end the guide pipe has cutting teeth for removing ground material. In particular, the cutting teeth are arranged in a ring-shaped manner on the lower edge of the guide pipe. Hence, in its lower area the guide pipe is designed similar to a drill pipe so that it can also be cut into harder ground material such as stone or rock.

The guide pipe is driven in a rotating manner by a guide pipe drive which preferably acts on the exterior of the guide pipe. In this way, the guide pipe drive can be arranged in a simple manner on the working platform next to the guide pipe. In this respect the invention envisages as a preferred embodiment the guide pipe drive having at least one collet drive with a collet, which embraces and clamps the guide pipe, whereby the collet can be twisted around a predetermined angle of twist via at least one twist cylinder arranged transversely to the pipe axis.

The collet acts at least on a partial area of the outer circumference of the guide pipe. Through appropriate clamping cylinders a force-locking connection is thus effected between the collet and the guide pipe. By way of laterally arranged twist cylinders, which substantially take effect tangentially to the exterior of the cylindrical guide pipe, the collet is subsequently displaced and thereby twisted around the axis of the guide pipe around a predetermined angle of twist. Afterwards, the clamping of the collets is released and through retraction of the twist cylinders the collet is moved back into the starting position. A renewed clamping and twisting of the guide pipe can then take place.

With a collet drive of such type a simple, compact and at the same time high-torque rotary drive is achieved for the guide pipe. The discontinuous mode of operation of such a collet drive is sufficient to drive the guide pipe preferably one meter to five meters deep into the bed of a body of water for anchoring the working platform.

In order to allow for sufficient forward thrust for the purpose of drilling the guide pipe into the bed of a body of water a helical flight can be provided by means of strips on the exterior of the guide pipe. However, according to the invention it is especially preferred that the collet drive has at least one feed cylinder arranged longitudinally to the drilling axis, through which the collet and the clamped guide pipe can be moved in the direction of the drilling axis. Hence, with the feed cylinder defined forces can be applied parallel to the axis of the guide pipe in the direction of the bed of a body of water. This permits a good and reliable feed motion during the introduction of the guide pipe.

According to the invention it is furthermore preferred that the drill drive of the drilling tool can be secured on the guide pipe. The drill drive for the drilling tool is a drive unit known in prior art for driving the drilling tool in a continuously rotating fashion. The drilling tool can be a customary drill head or a drill pipe which itself remains in the ground as a foundation element. In this case, the drill drive is preferably fixed via tension clamps on the upper side of the guide pipe in a relatively tight manner thereto. After production of the drill-hole by means of the drilling tool the drill drive can be released again from the guide pipe and removed from the working platform. To this end the drill drive can be supported in a known manner on a rope and retrieved onto a watercraft. Afterwards, a pile-shaped foundation element can be inserted into the drill-hole and anchored therein with concrete.

For alignment of the working platform on the bed of a body of water it is furthermore advantageous in accordance with the invention that the ground contact elements are adjustable by means of lifting cylinders. In this way, an individual setting of the stroke of the lifting cylinders allows for unevenness of the bed of a body of water to be leveled out. As a result, a vertical alignment of the guide pipe can be set. According to the invention at least three ground contact elements are arranged in an approximately star-shaped fashion on the outer circumference of the working platform. Depending on the application of the working platform provision can also be made for more ground contact elements. For an initial anchoring of the working platform these elements themselves can be designed with pointed tips for penetration into the bed of a body of water. Basically, a rotating drive of the ground contact elements is also possible so that for the purpose of anchoring the working platform the ground contact elements are drilled into the bed of a body of water for a small area at least.

Moreover, the object stated at the beginning is solved by a method for introducing a foundation element into the bed of a body of water with an underwater drilling arrangement, in which a working platform of the underwater drilling arrangement is lowered to the bed of a body of water and placed with the ground contact elements onto the bed of a body of water, a guide pipe is drilled into the bed of a body of water by means of a guide pipe drive drill and subsequently a drilling tool inserted into the guide pipe is driven in a rotating manner by means of a drill drive, whereby a drill-hole is formed for receiving the foundation element. With this method the previously described advantages can be achieved in particular.

For an easy and high-torque introduction of the guide pipe provision is made according to the invention for the guide pipe to be driven in a discontinuous manner by means of a collet drive as a guide pipe drive.

To drive the drilling tool a different drive is preferably provided, and according to the invention it is preferred that the drilling tool is driven by means of the drill drive which is designed as a continuously operating rotary drive. In this way, a constant rotational movement with a constant torque can be generated which is particularly advantageous for the production of deep drill-holes.

In addition, according to the invention it is advantageous for the drill drive to be releasably secured on the guide pipe. The drill drive can be secured on the guide pipe as early as during lowering of the working platform onto the bed of a body of water. Alternatively, the drill drive can also be inserted into the guide pipe at a later stage when the working platform is already arranged on the seabed. In particular, several guide pipes can be arranged on the working platform so that after production of a first drill-hole the drill drive with the drilling tool can be released again from the guide pipe and then inserted into a second guide pipe for drilling a second drill-hole.

For an efficient production of a foundation element provision is made according to the invention in that during retraction of the drilling tool the drill-hole is filled with a hardening mass which hardens to form the foundation element. In this case, the drilling tool can be a flush drill head for example, through which ground material is removed initially and flushed out of the drill-hole. Afterwards, during retraction of the drilling tool from the drill-hole a hardening mass, more particularly concrete, can be introduced into the drill-hole through a hollow stem of the drilling tool in order to form the foundation element.

Furthermore, according to the invention it is of advantage that during or after formation of the foundation element the guide pipe is removed from the ground and lifted with the working platform from the bed of a body of water. For this purpose the guide pipe can be clamped firmly on the working platform. Through an appropriate lifting winch and/or activation of the lifting cylinders of the ground contact elements the working platform can then be removed from the bed of a body of water. Where necessary, release of the guide pipe from the bed of a body of water can also be assisted by a rotational movement by means of the guide pipe drive.

Figure 4:
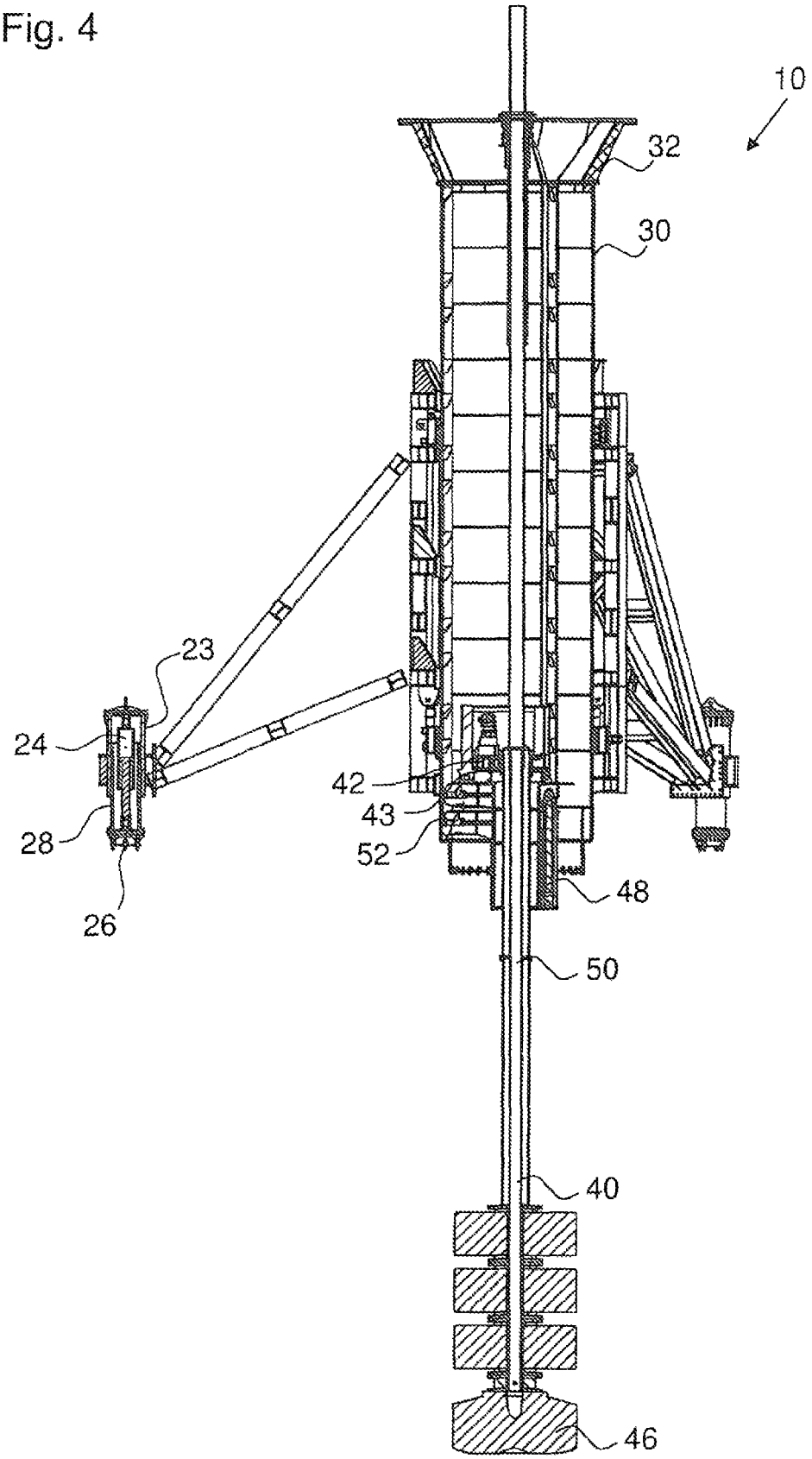

In the following the invention will be described further by way of preferred embodiment examples illustrated schematically in the accompanying drawings, wherein show:

FIG. 1 a side view of an underwater drilling arrangement according to the invention;

FIG. 2 a top view from above of the underwater drilling arrangement of FIG. 1;

FIG. 3 a side view of a further underwater drilling arrangement according to the invention with inserted drilling tool and FIG. 4 a sectional view of the underwater drilling arrangement of FIG. 3.

A basic construction of an underwater drilling arrangement 10 according to the invention can be taken from FIGS. 1 and 2. The said arrangement has a star-shaped working platform 20 with three horizontal base struts 18 which each extend radially to each other at the same angular distance. From the base struts 18 a drum-shaped frame 14 formed as a beam construction extends vertically upwards. The frame 14 is additionally connected via diagonal reinforcing struts 16 to the base struts 18. At the points of connection of the reinforcing struts 16 and the base struts 18 the ground contact elements 22 are arranged in each case. These have a prop which is vertically adjustable via a lifting cylinder 24. On the underside of the props actuated by the lifting cylinders 24 anchoring elements 26 are arranged. These anchoring elements 26 can be designed as pointed tips or cutting teeth, allowing the ground contact elements 22 to be anchored in the bed of a body of water.

For an additional anchoring of the working platform 20, according to the invention a cylindrical guide pipe 30 is supported in a rotatable and longitudinally displaceable manner inside the drum-shaped frame 14. On the underside of the guide pipe 30 a toothed ring of smaller diameter with cutting teeth 34 is designed. On the upper side of the guide pipe 30 an at least segmentally designed inserting hopper 32 is provided which facilitates capturing and insertion of a cylindrical drilling tool 40 into the guide pipe 30. The drilling tool 40 is supplied via a supply line 44 with energy, flush liquid and/or hardening mass, in particular concrete, from a supply vessel, not illustrated. Via a rope and winch arrangement, not depicted, the working platform 20 is also connected to the supply vessel and supplied from there with energy.

Another underwater drilling arrangement 10 according to the invention is shown in a modified form in FIGS. 3 and 4. The indicated identical reference signs refer to the parts with identical function, in which case reference is made to the previous description.

Just as in the case of the previously described embodiment the working platform 20 has base struts 18 and reinforcing struts 16 in a star-shaped arrangement which extend between the support elements 22 and the drum-shaped frame 14. In this embodiment the base struts 18 are positioned like the reinforcing struts 16 in an acute angle with respect to a drilling axis 12.

According to FIG. 4 the ground contact elements 22 comprise a housing 23 which receives the actual lifting cylinder 24. On the piston of the lifting cylinder 24 extensible, column-shaped props 28 are arranged, on the underside of which pointed anchoring elements 26 for anchoring in the bed of a body of water are arranged.

For an additional anchoring the guide pipe 30 is supported in an axially adjustable and twistable manner in the drum-shaped frame 14. To this end a guide pipe drive 60 with two collet drives 61*a* and 6l*b* is provided. The two collet drives 61*a*, 6l*b* each have a collet 62*a*, 62*b* embracing the guide pipe 30, which can be applied to the guide pipe 30 by means of a clamping cylinder, not depicted, for holding the said guide pipe in a force-locking manner. Via horizontally directed twist cylinders 64*a*, 64*b* the collet 62*a*, 62*b* supported in a twistable manner can be twisted together with the guide pipe 30 around a predetermined angle of twist. To feed the guide pipe 30 the twist movement can be assisted by an axial movement longitudinally of the drilling axis 12. For this purpose a vertically arranged feed cylinder 66 is arranged between the collet 61 and the frame 14.

The two collet drives 61*a*, 61*b* are axially spaced and turned in the circumferential direction with respect to each other. To reach an at least quasi-continuous rotary drive a first collet drive 61*a* can initially carry out a twist movement while the other, second collet drive 61*b* is reset into its starting position. In this way, the two collet drives 61*a*, 61*b* can alternately carry out a twist movement of the guide pipe 30 or can be reset respectively.

By drilling the guide pipe 30 into the bed of a body of water a reliable anchoring and support of the working platform 20 is achieved. Afterwards, the drilling tool 40 can be inserted via the inserting hopper 32 into the guide pipe 30.

As can be taken from the cross-sectional view according to FIG. 4, the drilling tool 40 has a drill drive 42 with a housing 43 which is secured by means of hydraulically actuated clamping elements 52 on the interior of the guide pipe 30. The continuously rotating drill drive 42 drives a drill rod 50, at the lower end of which a drill head 46 for removing rock material is arranged. In addition to the rotational movement of the drill drive 42 a drill feed cylinder 48 is arranged which can additionally apply an axial force onto the drill head 46.

The drilling tool 40 with the drill drive 42 is connected as a flying drilling apparatus via a rope arrangement, not depicted, to a supply vessel and can be retracted again from the guide pipe 30 on completion of the drilling operations. Subsequently, a foundation element can be formed in the drill-hole, in particular by inserting and anchoring a pile therein.

The invention claimed is:

1. Underwater drilling arrangement for introducing a foundation element into a bed of a body of water comprising:

a submersible working platform for placement onto the bed of a body of water, several ground contact elements, which are arranged in an adjustable manner on the working platform for aligning the working platform on the bed of a body of water, and at least one guide pipe arranged on the working platform, which is designed to receive and guide a drilling tool driven by a drill drive, wherein the guide pipe is supported in a longitudinally displaceable and rotatable manner on the working platform, on the working platform a guide pipe drive is provided for driving the guide pipe in a rotating manner; and the guide pipe drive has at least one collet drive with a collet, which embraces and clamps the guide pipe, whereby the collet can be twisted around a predetermined angle of twist via at least one twist cylinder arranged transversely to the pipe axis.

2. Underwater drilling arrangement according to claim 1, wherein at its upper end the guide pipe has an inserting hopper for inserting the drilling tool.

3. Underwater drilling arrangement according to claim 1, wherein at its lower end the guide pipe has cutting teeth for removing ground material.

4. Underwater drilling arrangement according to claim 1, wherein the collet drive has at least one feed cylinder arranged longitudinally to the drilling axis, through which the collet and the clamped guide pipe can be moved in the direction of the drilling axis.

5. Underwater drilling arrangement according to claim 1, wherein the drill drive of the drilling tool can be secured on the guide pipe.

6. Underwater drilling arrangement according to claim 1, wherein the ground contact elements are adjustable by means of lifting cylinders.

7. Method for introducing a foundation element into a bed of a body of water with an underwater drilling arrangement, in particular according to claim 1, in which a working platform of the underwater drilling arrangement is lowered to the bed of a body of water and placed with the ground contact elements onto the bed of a body of water, a guide pipe is drilled into the bed of a body of water by a guide pipe drive; and subsequently a drilling tool inserted into the guide pipe is driven in a rotating manner by a drill drive, whereby a drill-hole is formed for receiving the foundation element.

8. Method according to claim 7, wherein
the guide pipe is driven in a discontinuous manner by a collet drive as a guide pipe drive.

9. Method according to claim 7, wherein
the drilling tool is driven by the drill drive which is designed as a continuously operating rotary drive.

10. Method according to claim 7, wherein
the drill drive is releasably secured on the guide pipe.

11. Method according to claim 7, wherein
during retraction of the drilling tool the drill-hole is filled with a hardening mass which hardens to form the foundation element.

12. Method according to claim 7, wherein
during or after formation of the foundation element the guide pipe is removed from the ground and lifted with the working platform from the bed of a body of water.

* * * * *